US006702305B2

(12) United States Patent
Miles

(10) Patent No.: US 6,702,305 B2
(45) Date of Patent: Mar. 9, 2004

(54) INCLINABLE CREEPER

(75) Inventor: Joseph J. Miles, Plant City, FL (US)

(73) Assignee: United Auto Systems, Inc., Zephyrhills, FL (US)

( * ) Notice: Subject to any disclaimer, the term of this patent is extended or adjusted under 35 U.S.C. 154(b) by 0 days.

(21) Appl. No.: 09/906,038

(22) Filed: Jul. 15, 2001

(65) Prior Publication Data

US 2003/0168824 A1 Sep. 11, 2003

(51) Int. Cl.[7] ..... B25H 5/00
(52) U.S. Cl. ..... 280/32.6; 280/32.5; 280/79.11
(58) Field of Search ..... 280/32.6, 32.7, 280/32.5, 79.11; 297/362.13, 377; 5/614, 617, 618, 632, 634, 636

(56) References Cited

U.S. PATENT DOCUMENTS

| | | | | | |
|---|---|---|---|---|---|
| 2,054,598 | A | * | 9/1936 | Goldenberg | 280/32.6 |
| 2,520,047 | A | * | 8/1950 | Moody et al. | 280/32.6 |
| 2,703,717 | A | * | 3/1955 | Miller | 280/32.6 |
| 2,788,529 | A | * | 4/1957 | Moritzacky | 5/614 |
| 2,861,279 | A | * | 11/1958 | Myers | 280/32.6 |
| 3,148,892 | A | * | 9/1964 | Merriott | 280/32.6 |
| 4,062,156 | A | * | 12/1977 | Roth | 343/883 |
| 4,614,128 | A | * | 9/1986 | Fickler | 74/89.31 |
| 4,754,507 | A | * | 7/1988 | Edge | 5/633 |
| 5,044,647 | A | * | 9/1991 | Patterson | 180/907 |
| 5,108,118 | A | * | 4/1992 | Schaevitz | 280/32.6 |
| 5,261,725 | A | * | 11/1993 | Rudolph | 297/354.13 |
| 5,320,412 | A | * | 6/1994 | Eakins et al. | 297/284.1 |
| 5,402,543 | A | * | 4/1995 | Dietrich et al. | 5/610 |
| 5,575,026 | A | * | 11/1996 | Way et al. | 5/611 |
| D384,466 | S | * | 9/1997 | Taylor | D34/23 |
| 5,926,876 | A | * | 7/1999 | Haigh et al. | 5/616 |
| 6,095,532 | A | * | 8/2000 | Martin | 280/30 |
| 6,393,641 | B1 | * | 5/2002 | Hensley | 5/613 |
| 6,409,452 | B1 | * | 6/2002 | Zibella et al. | 414/401 |
| 6,425,590 | B1 | * | 7/2002 | Whiteside et al. | 280/32.5 |

FOREIGN PATENT DOCUMENTS

| | | | | |
|---|---|---|---|---|
| FR | 002635665 | A1 * | 3/1990 | 5/617 |

* cited by examiner

*Primary Examiner*—Brian L. Johnson
*Assistant Examiner*—Kelly E Campbell
(74) *Attorney, Agent, or Firm*—Holland & Knight LLP

(57) ABSTRACT

An inclinable creeper including a carriaged framework supporting a bed, the bed including an inclinable portion and a mechanism for raising the inclinable portion upon actuation of a lever, for securing the inclinable portion when the lever is not actuated, and for allowing the inclinable portion to be forcibly lowered when the lever is actuated.

10 Claims, 10 Drawing Sheets

INCLINABLE CREEPER

FIELD OF THE INVENTION

This invention relates to mechanics creepers. More particularly, this invention relates to mechanics creepers having an inclinable headrest or upper bed for raising the head or upper torso of the mechanic.

DESCRIPTION OF THE BACKGROUND ART

Presently there exist many types of mechanics creepers. Most include a low-slung carriaged framework on which is supported a headrest and a bed (upper portion for the upper torso and a lower portion for seating. During use, the mechanic lies face-up on the creeper with his torso positioned on the bed and with his head resting on the headrest. Being at a low-level, prone position on the creeper, the mechanic is allowed to underneath the vehicle, thereby gaining ready access to the underside of the vehicle to work on the same.

In view of the long periods of lying on the creeper and working underneath the vehicle, it has long been desirable to configure the bed and headrest to be as comfortable as possible for the mechanic. Thus, as shown in the above-referenced patents, some creepers include contoured beds or headrests. Further, in order to reduce neck strain from reaching up into the underside of the vehicle, many creepers have been designed with inclinable beds and/or headrests.

U.S. Pat. No. 4,895,380, the disclosure of which is hereby incorporated by reference herein, discloses one type of creeper in which bed thereof is inclinable. Unfortunately, however, the inclination mechanism of such a creeper is complex in construction and often requires the mechanic to wheel himself out from under the vehicle to reposition the inclination of the headrest or upper bed.

In view of the foregoing, there presently exists a need for a creeper that allows the mechanic to easily raise and lower the headrest or upper bed thereof as needed while underneath the vehicle.

Therefore, it is an object of this invention to provide an improvement which overcomes the aforementioned inadequacies of the prior art creepers and provides an improvement which is a significant contribution to the advancement of the mechanics creeper art.

Another object of this invention is to provide a mechanics creeper that allows the mechanic to easily raise and lower the headrest or upper bed thereof as needed while underneath the vehicle.

Another object of this invention is to provide a mechanics creeper wherein the raising of the headrest or upper bed occurs by simple operation of a lever of a gas spring or a linear actuator, that when actuated, causes the headrest or upper bed to raise automatically to the desired inclined level, whereupon the lever is then released to secure the headrest or upper bed in such an inclined position.

Another object of this invention is to provide a mechanics creeper wherein the lowering of the headrest or upper bed occurs by simple operation of a lever of a gas spring, such that when actuated, allows the mechanic to push backwardly onto the headrest or upper bed to force the headrest or upper bed to lower to the desired level, whereupon the lever is then released to secure the headrest or upper bed in such a reduced inclined or flat position.

Another object of this invention is to provide a mechanics creeper wherein the lowering of the headrest or upper bed occurs by simple operation of a lever of a linear actuator, such that when actuated, lowers the headrest or upper bed to the desired level, whereupon the lever is then released to secure the headrest or upper bed in such a reduced inclined or flat position.

Another object of this invention is to provide an inclinable mechanics creeper that retains the normal appearance of conventional creepers, and is not otherwise bulky or complicated in structure or operation.

Another object of this invention is to provide an inclinable mechanics creeper that is economical to manufacture.

The foregoing has outlined some of the pertinent objects of the invention. These objects should be construed to be merely illustrative of some of the more prominent features and applications of the intended invention. Many other beneficial results can be attained by applying the disclosed invention in a different manner or modifying the invention within the scope of the disclosure. Accordingly, other objects and a fuller understanding of the invention and the detailed description of the preferred embodiment in addition to the scope of the invention defined by the claims taken in conjunction with the accompanying drawings.

SUMMARY OF THE INVENTION

For the purpose of summarizing this invention, this invention comprises a mechanics creeper having a bed with an inclinable portion, such as a headrest or headrest/upper bed that is inclinable by means of a gas spring or linear actuator, operated by a lever, that is pivotally interconnected between the framework of the creeper and the headrest or headrest/upper bed.

More particularly, the creeper of the invention comprises a pair of side frame members and a plurality of transverse cross members forming a carriage. Caster wheels are operatively connected to the carriage to allow the carriage to be rolled about on the floor. The creeper bed is connected to the transverse cross members to be supported thereby in a low profile close to the floor.

In the case of an inclinable headrest, the headrest is mounted to an inclinable frame and the gas spring is interconnected between the carriage frame and the inclinable frame. In the case of an inclinable headrest/upper bed, the headrest and the upper portion of the bed (corresponding to the head and upper torso of the mechanic) are formed together as a unit separate from the lower portion of the bed (on which the mechanic is seated). The headrest/upper bed portion is mounted to the inclinable frame, with the gas spring or linear actuator being interconnected between the carriage frame and the inclinable frame.

The inclinable creeper of the invention allows the mechanic to easily raise and lower the headrest or headrest/upper bed thereof as needed while underneath the vehicle. More particularly, the lever of the gas spring or linear actuator is positioned just underneath the headrest or headrest/upper bed portion of the creeper to be easily actuated by the mechanic by simply reaching just under his head or his lower back.

The raising of the headrest or upper bed may occur by simple operation of the lever by the mechanic coupled with the mechanic lifting-up his head and upper torso to take the weight off the headrest or upper bed (i.e., by performing a slight sit-up). When so actuated, the headrest or upper bed rises automatically to the desired inclined level. The mechanic may then release the lever to secure the headrest or upper bed in such an inclined position.

Conversely, the lowering of the headrest or headrest/upper bed may occur by simple operation of the lever. In the case of the gas spring embodiment, operation of the lever coupled with a backward pushing on the headrest or headrest/upper bed by the mechanic's head or head & upper back, forces the headrest or headrest/upper bed to lower to the desired level, whereupon the lever may then released to secure the headrest or headrest/upper bed in such a reduced inclined or flat position. In the case of the linear actuator embodiment, actuation of the lever causes the headrest or headrest/upper bed to lower to the desired level, whereupon the lever may then released to secure the headrest or headrest/upper bed in such a reduced inclined or flat position.

As the gas spring or linear actuator is installed underneath the headrest or upper bed, it is concealed from view. Thus, the creeper retains the normal appearance of conventional creepers, and is not otherwise bulky or complicated in structure or operation. Further, it is economical to manufacture.

The foregoing has outlined rather broadly the more pertinent and important features of the present invention in order that the detailed description of the invention that follows may be better understood so that the present contribution to the art can be more fully appreciated. Additional features of the invention will be described hereinafter which form the subject of the claims of the invention. It should be appreciated by those skilled in the art that the conception and the specific embodiment disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims.

BRIEF DESCRIPTION OF THE DRAWINGS

For a fuller understanding of the nature and objects of the invention, reference should be had to the following detailed description taken in connection with the accompanying drawings in which.

Similar reference characters refer to similar parts throughout the several views of the drawings.

DETAILED DESCRIPTION OF THE PREFERRED EMBODIMENT

A mechanics creeper 10 according to the present invention generally comprises a generally rectangular carriage framework 12 including pair of opposing tubular side frame members 12S and a plurality of transverse cross members 12T (e.g., head-end cross member 12TH, middle cross member 12TM and foot-end cross member 12TF). A plurality of caster wheels 14 are connected to the framework 12 to form a low slung carriage. A bed, generally indicated by numeral 20, is secured to the framework 12.

Figure 1A:
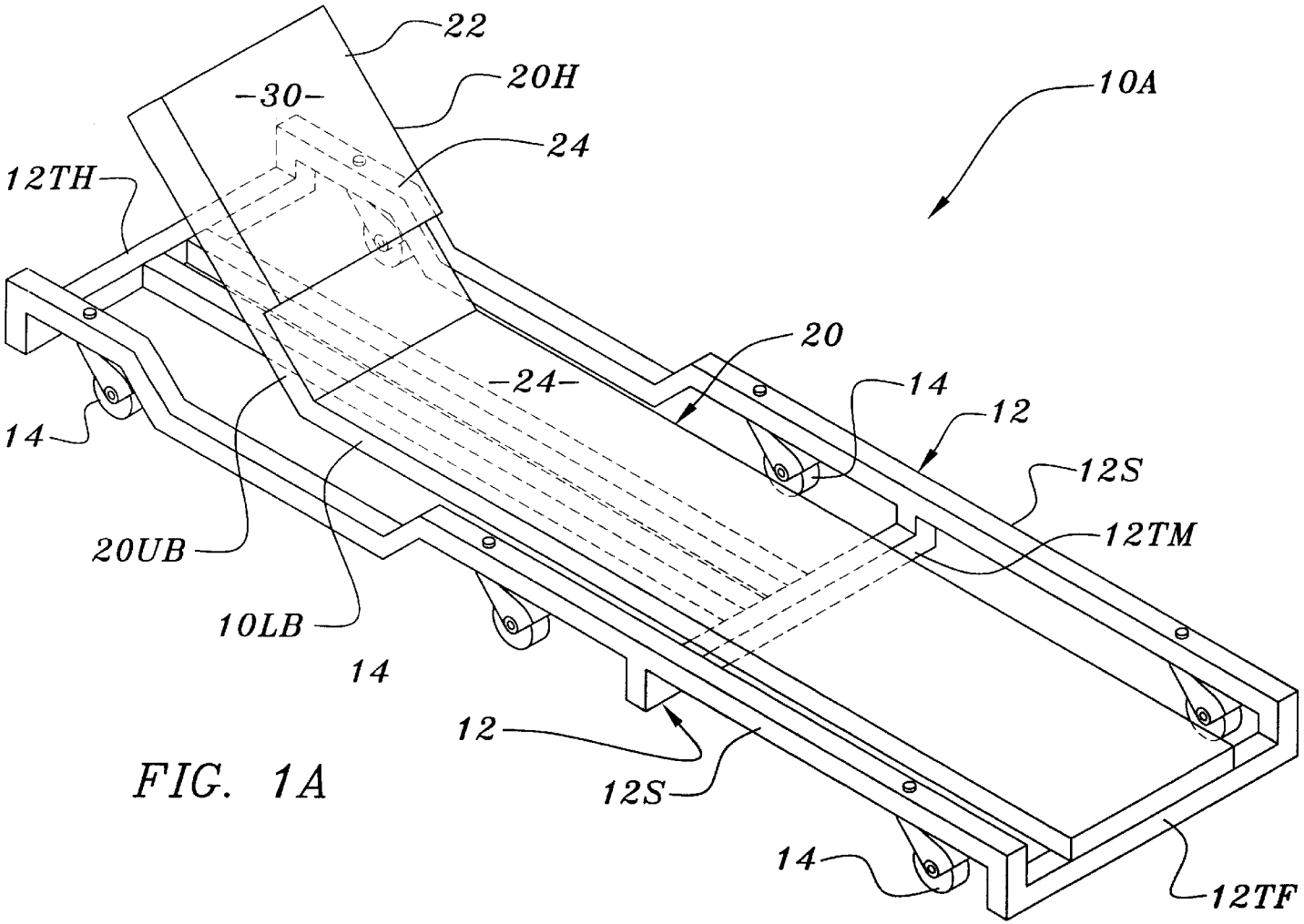
FIG. 1A is a perspective view of mechanics creeper having the inclinable headrest of the invention incorporated therein and illustrating the opposing side frame members, the caster wheels, and the headrest and bed of the creeper.
Figure 1B:
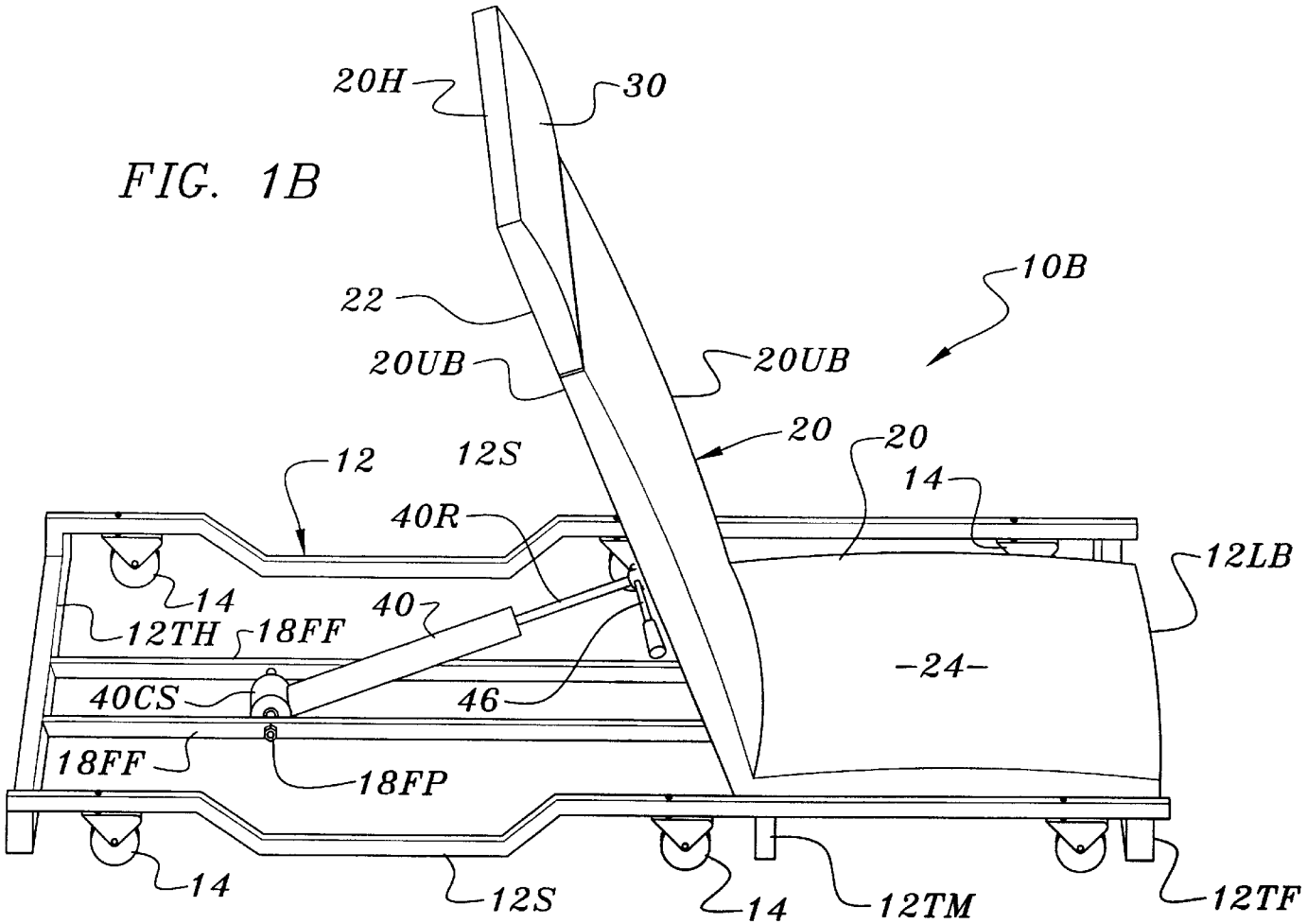
FIG. 1B is a perspective view of mechanics creeper having the inclinable headrest/upper bed of the invention incorporated therein and illustrating the opposing side frame members, the caster wheels, and the headrest and bed of the creeper.
Figure 2A:
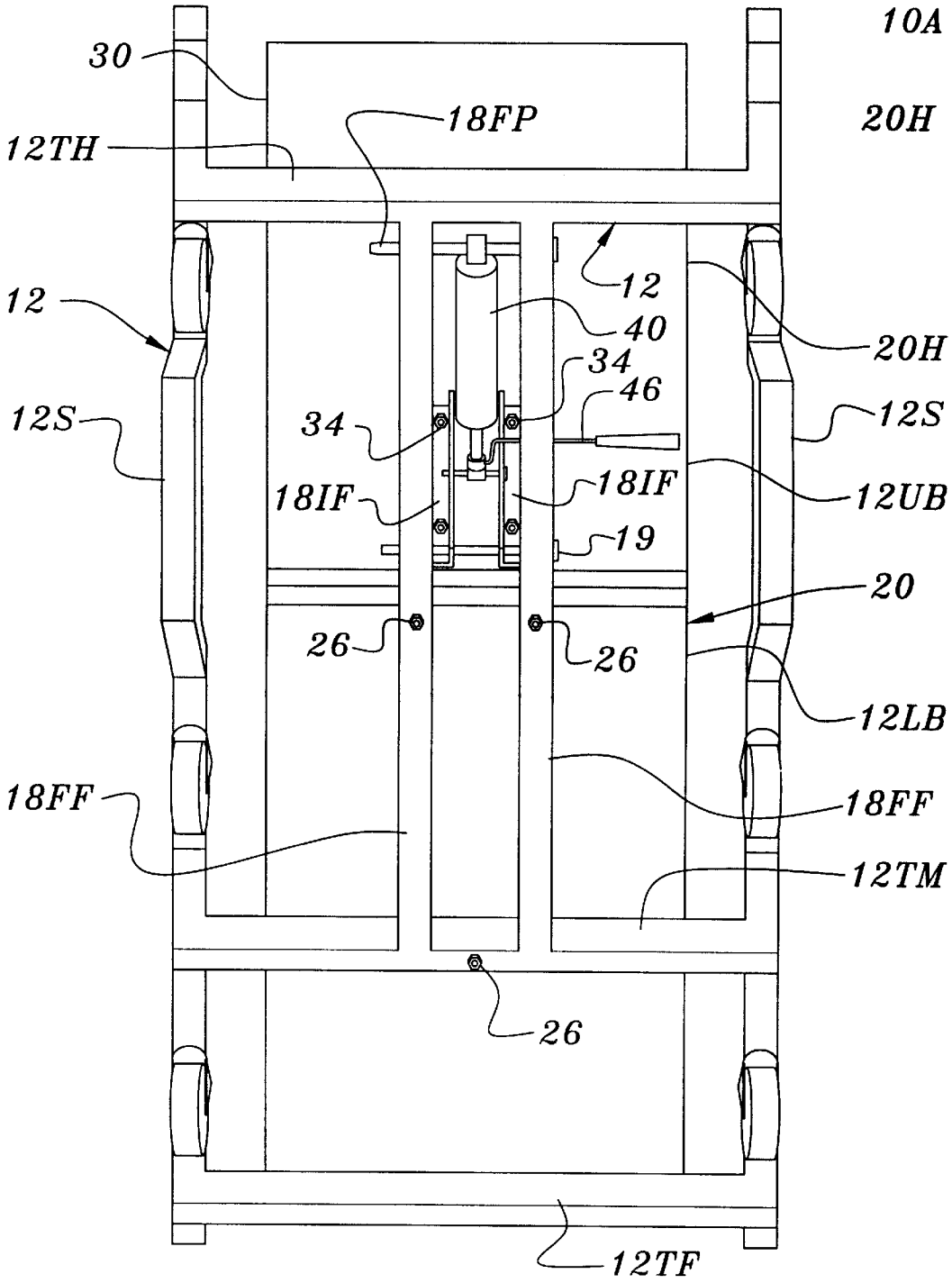
FIG. 2A is a bottom view of the underside of the mechanics creeper having the inclinable headrest of the invention incorporated therein and illustrating the gas spring positioned between one of the transverse cross members and the headrest for raising the headrest.
Figure 2B:
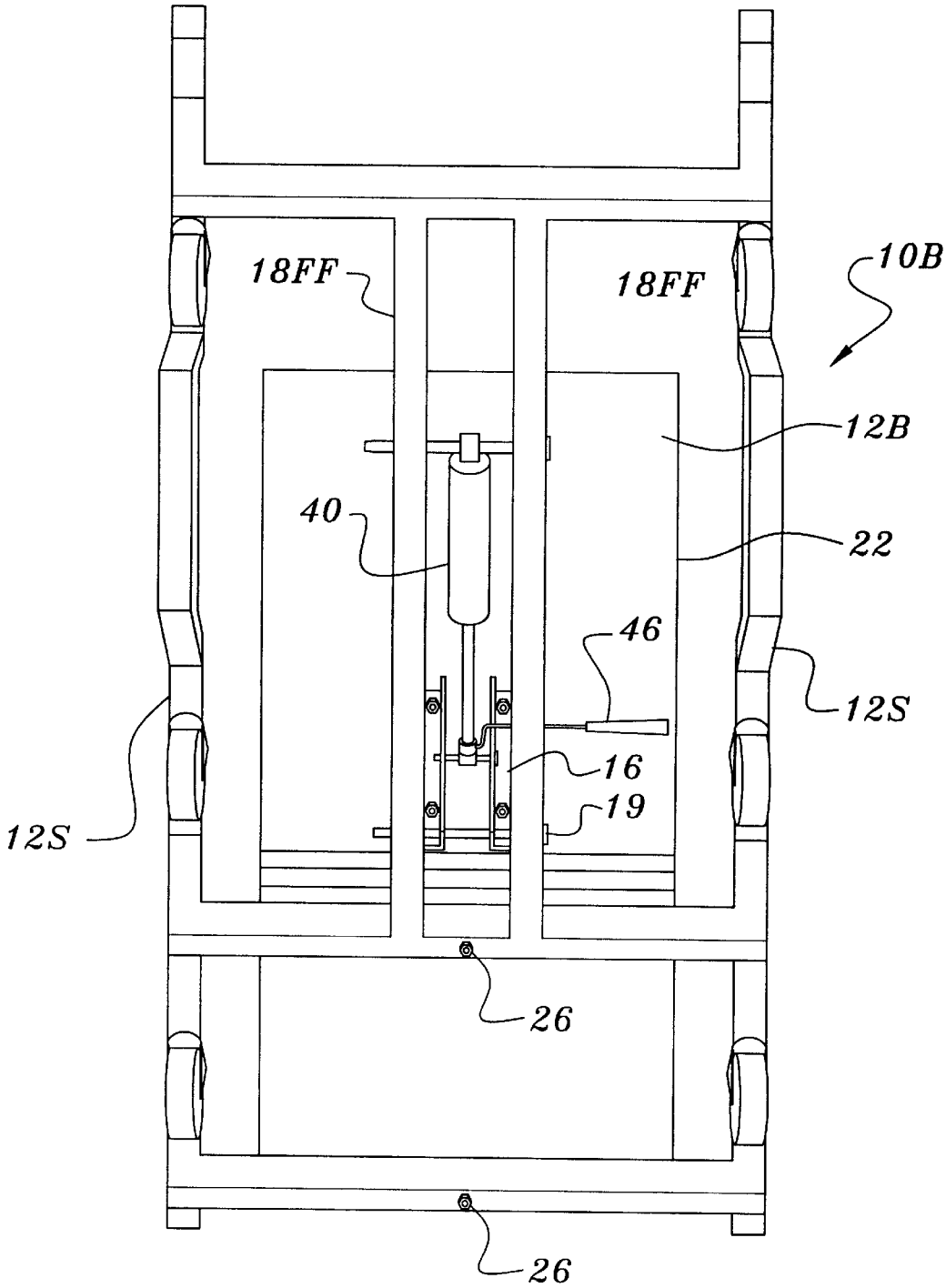
FIG. 2B is a bottom view of the underside of the mechanics creeper having the inclinable headrest/upper bed of the invention incorporated therein and illustrating the gas spring positioned between one of the transverse cross members and the headrest/upper bed for raising the headrest/upper bed.
Figure 3A:
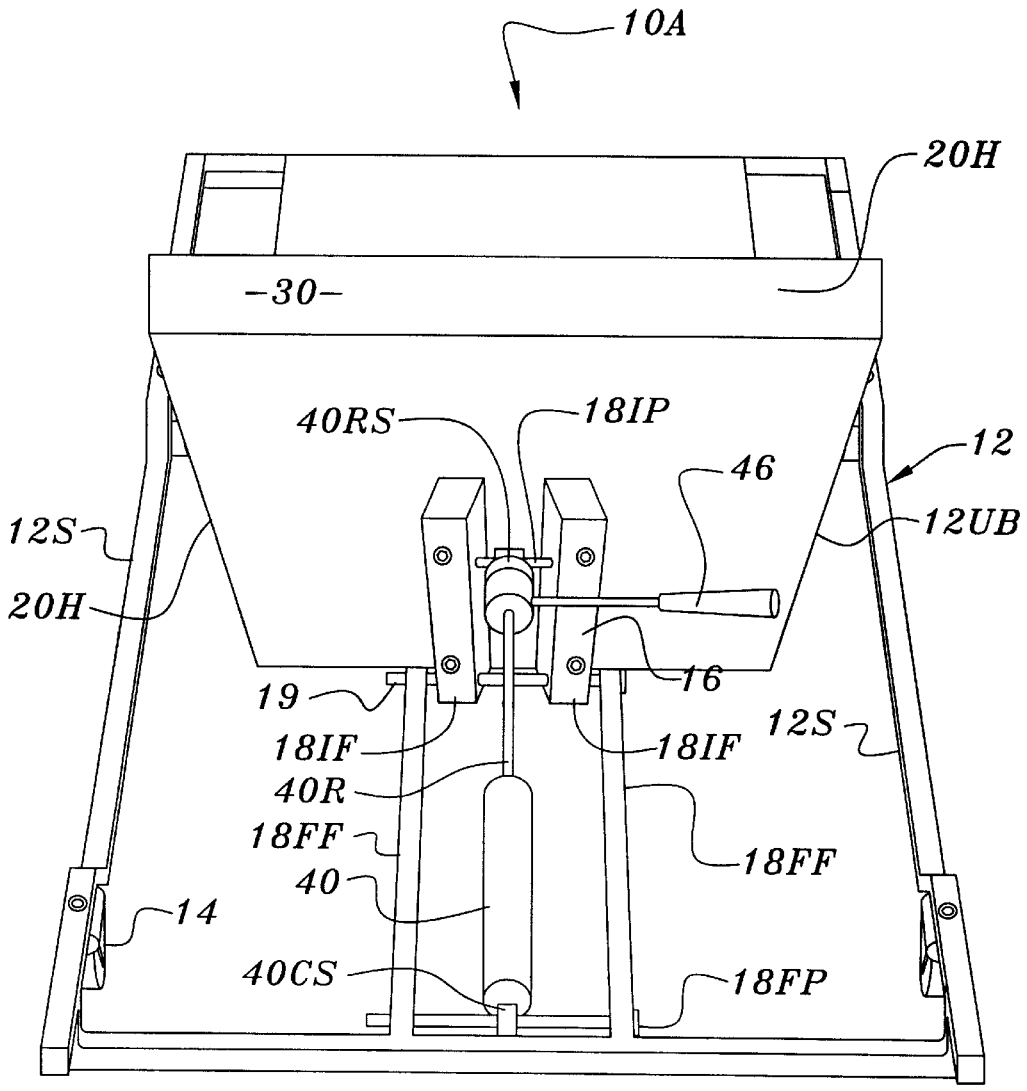
FIG. 3A is a bottom perspective view of the underside of the mechanics creeper having the inclinable headrest of the invention incorporated therein and with headrest having been inclined to a raised position.
Figure 3B:
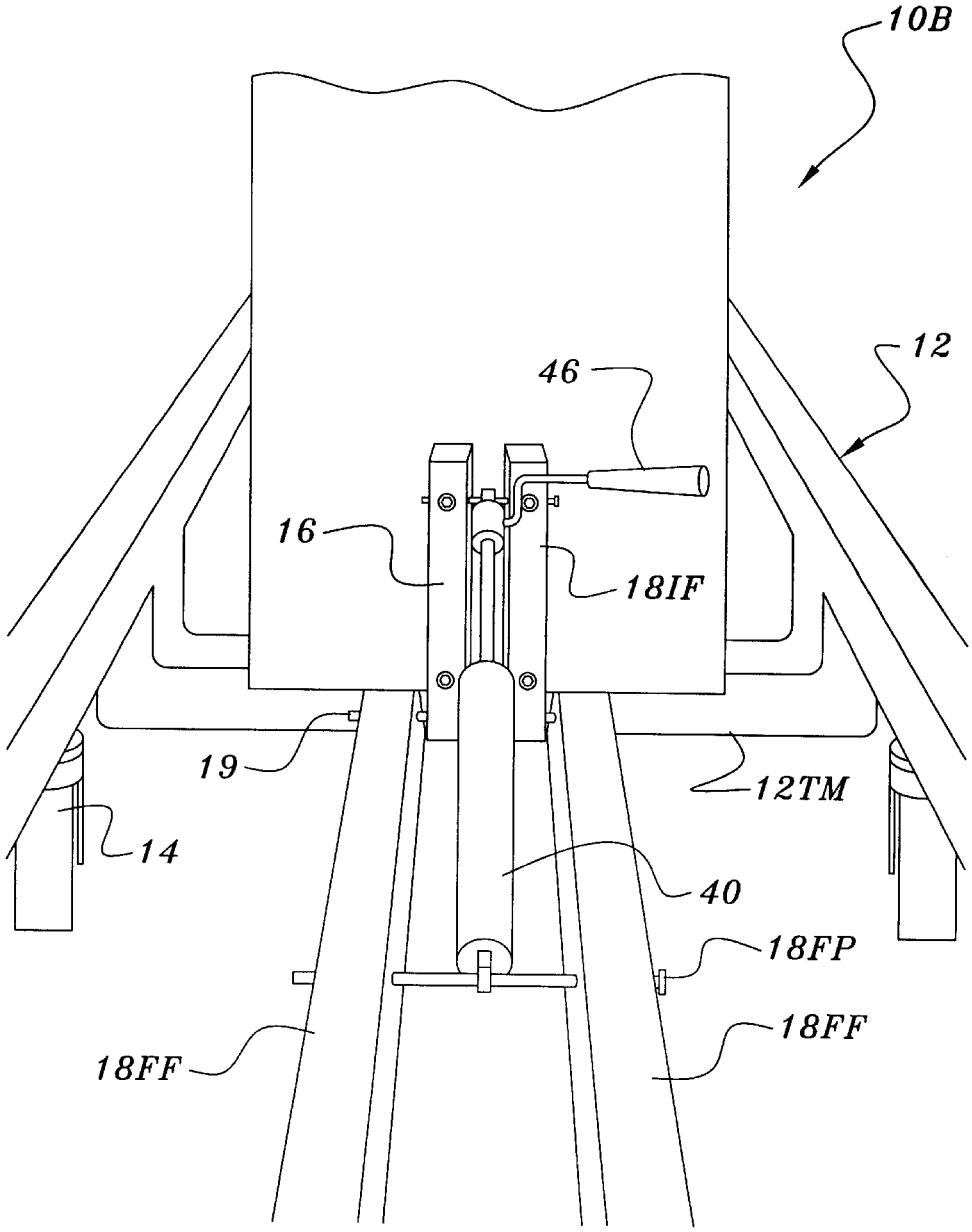
FIG. 3B is a bottom perspective view of the underside of the mechanics creeper having the inclinable headrest/upper bed of the invention incorporated therein and with headrest/upper bed having been inclined to a raised position.

An inclinable framework 16 is provided for inclining a portion of the bed 20. In the first embodiment of the inclinable mechanic creeper 10A, the inclinable portion of the bed 20 comprises an inclinable headrest 20H as shown in FIGS. 1A, 2A & 3A whereas in the second embodiment the inclinable portion of the bed 20 comprises an inclinable headrest/upper bed 20UB as shown in FIGS. 1B, 2B and 3B. In both embodiments, the inclinable framework 16 comprises a fixed frame 18FF rigidly connected between the head-end cross member 12TH and the middle cross member 12TM and a inclinable frame 181F pivotally connected to the fixed frame 18FF by means of a pivot pin 19 that allows the inclinable frame 18IF to be inclined upwardly to an included position.

More particularly, in the first embodiment of the inclinable creeper 10A as shown in FIGS. 1A, 2A & 3A, bed 20 comprises a headrest 20H and an upper and lower bed portion 20UB & 20LB. The upper and lower bed portions 20UB & 20LB are integrally formed of a rigid material 22 such as plywood that is then covered with a soft cushion 24 such foam-padded vinyl. The upper and lower bed portions 20UB & 20LB are then affixed to the middle and foot-end transverse cross members 12TM & 12TF such as by fasteners 26 that are positioned through holes in the cross members 12T and are threaded into the underside of the rigid material 22. In the case of the rigid material 22 comprising plywood, the cushion 24 may be wrapped around and affixed to the plywood by staples and the fasteners 26 may simply comprise wood screws.

In the first embodiment of the inclinable creeper 10A as shown in FIGS. 1A, 2A & 3A, the headrest 20H comprises a similar rigid material 28 such as plywood on which is positioned a foam pillow 30 wrapped with vinyl and secured to the underside of the rigid material 28 such as by staples. The headrest 20H is rigidly connected to the inclinable frame 18IF such as by fasteners 34 that are positioned through holes in the pivotal fame 18IF and are threaded into the underside of the rigid material 28.

In the second embodiment of the inclinable creeper 10A as shown in FIGS. 1B, 2B & 3B, only the lower bed 20LB, formed of a rigid material 22 that is then covered with a soft cushion 24, is affixed to the middle and foot-end transverse cross members 12TM & 12TF by the fasteners 26. The rigid material 28 constitutes the upper bed portion 20UB and the headrest 20H and is respectively covered with the cushion 22 & foam pillow 30. The headrest 20H and upper bed 20UB is rigidly connected to the inclinable frame 18IF such as by fasteners 34 that are positioned through holes in the inclinable fame 18IF and are threaded into the underside of the rigid material 28.

The inclinable frame 18IF preferably comprises a pair of parallel, spaced-apart members that are rigidly secured to the rigid material 28. Likewise, the fixed frame 18FF preferably comprises a pair of parallel, spaced-apart members that are rigidly secured between the head-end cross member 12TH and middle cross member 12TM of the carriage framework 12. Also preferably, the paired parallel, spaced-apart members of the fixed frame 18FF are spaced far enough apart such that the pair of parallel, spaced-apart members of inclinable frame 18IF can pivot between them by means of the pivot pin 19. It is noted that in lieu of the inclinable frame 18IF being pivotally connected to the fixed frame 18FF, the upper bed portion 20UB and the headrest 20H may be pivotally connected directly to the lower bed 20LB such as by leaf hinges fixed to the rigid material 22 or directly to the transverse cross member 12TM such as by a piano hinge.

Figure 4:
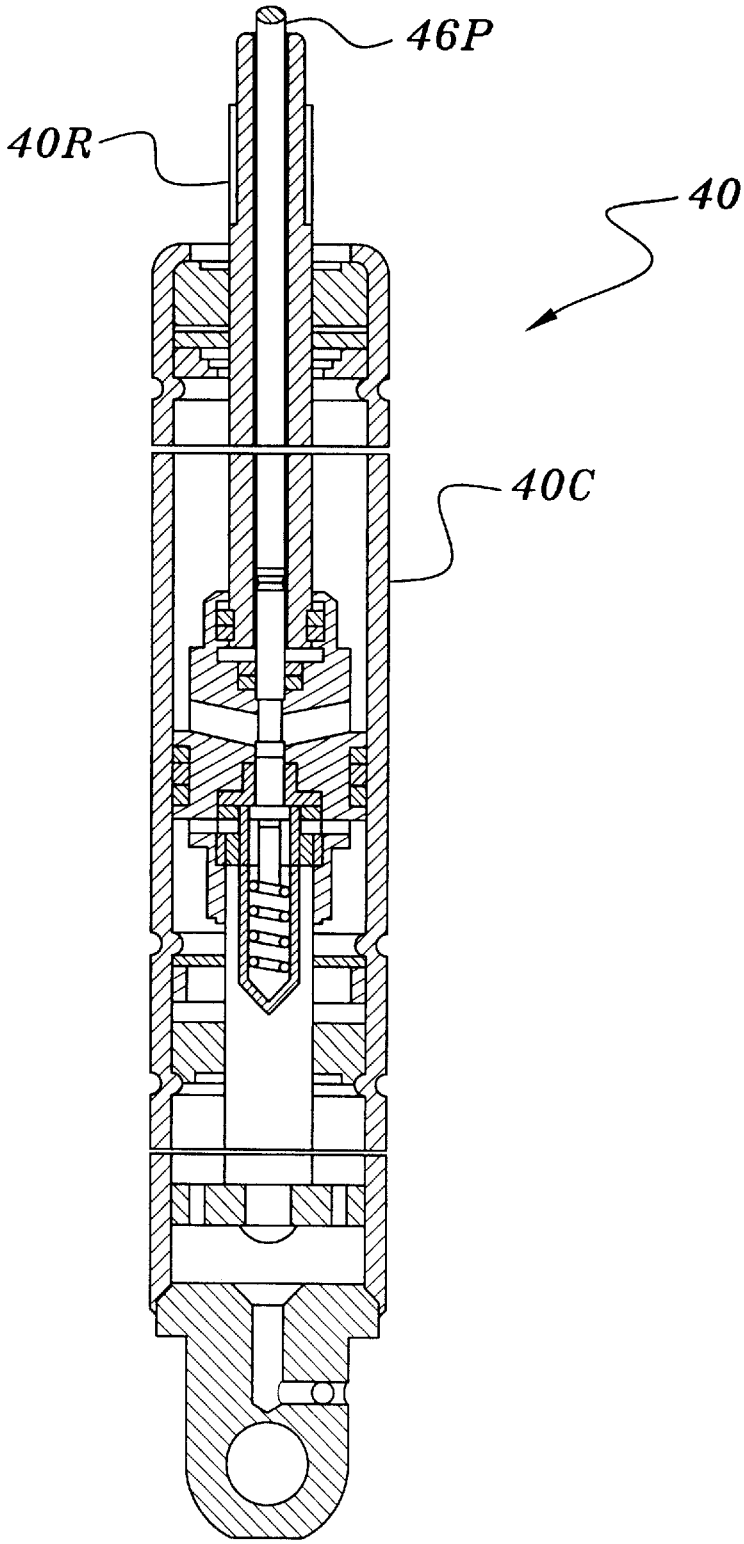
FIG. 4 is a partial cut-away view of a conventional gas spring.
Figure 5:
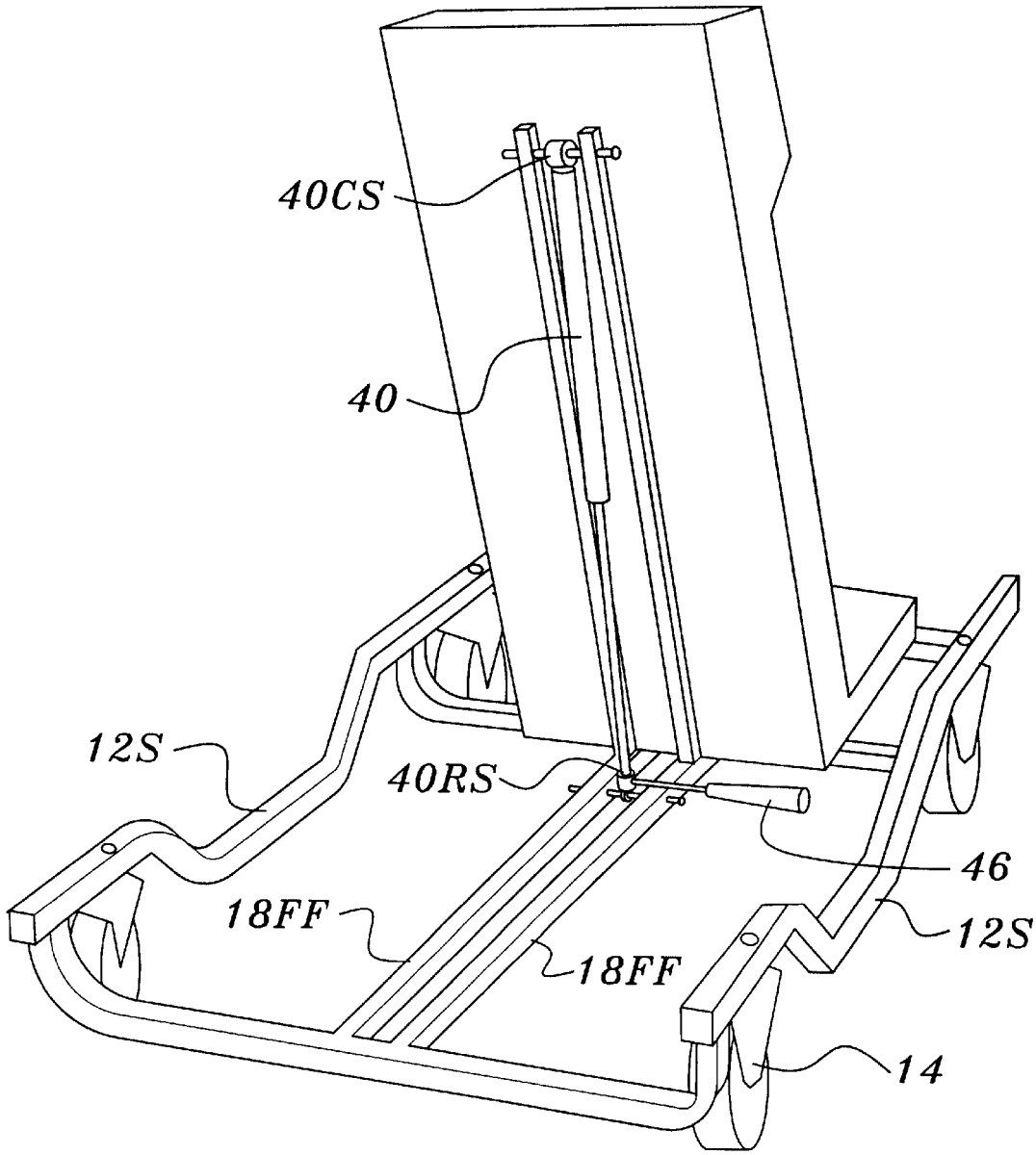
FIG. 5 is a bottom perspective underside view of another embodiment of the mechanics creeper.
Figure 6:
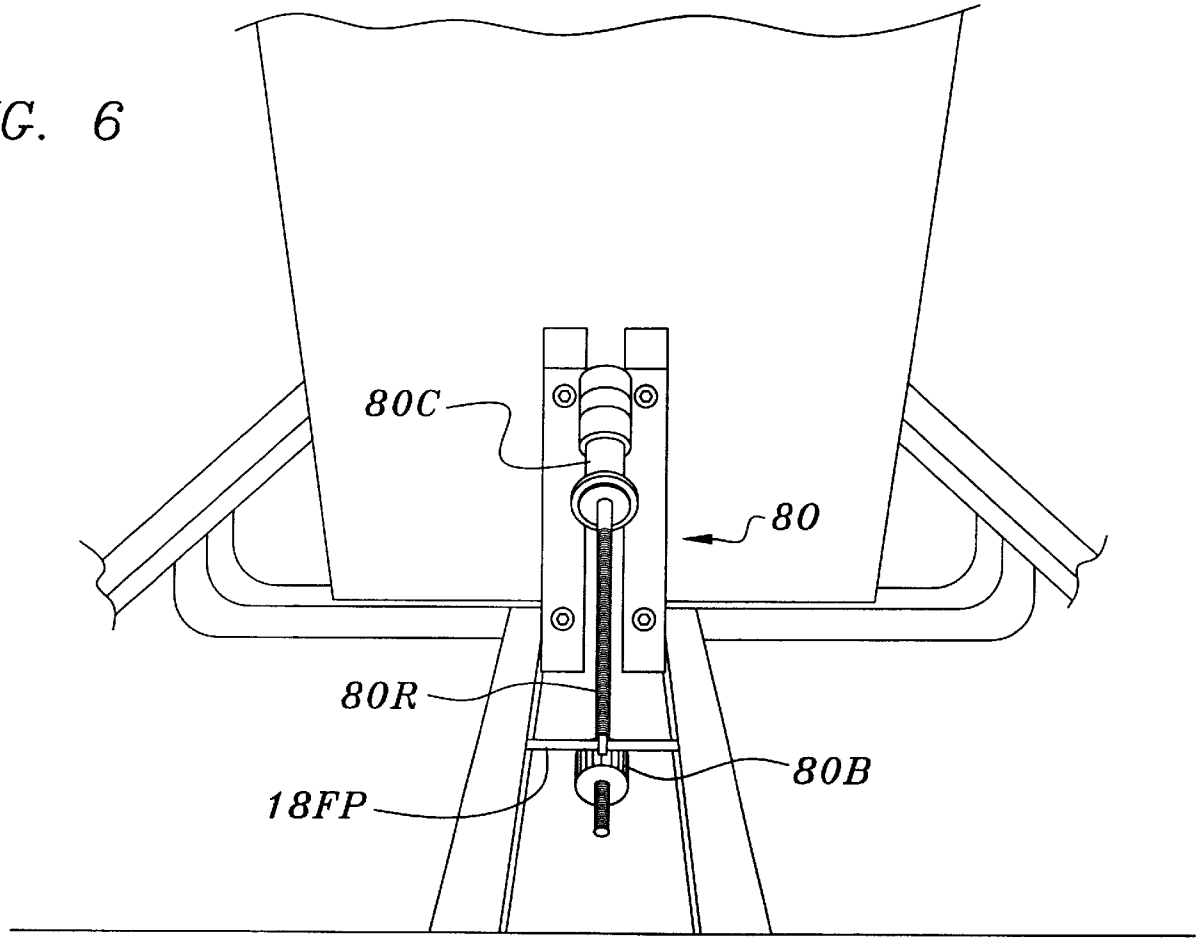
FIG. 6 is a perspective underside view of the mechanics creeper of the invention employing a linear actuator.
Figure 7:
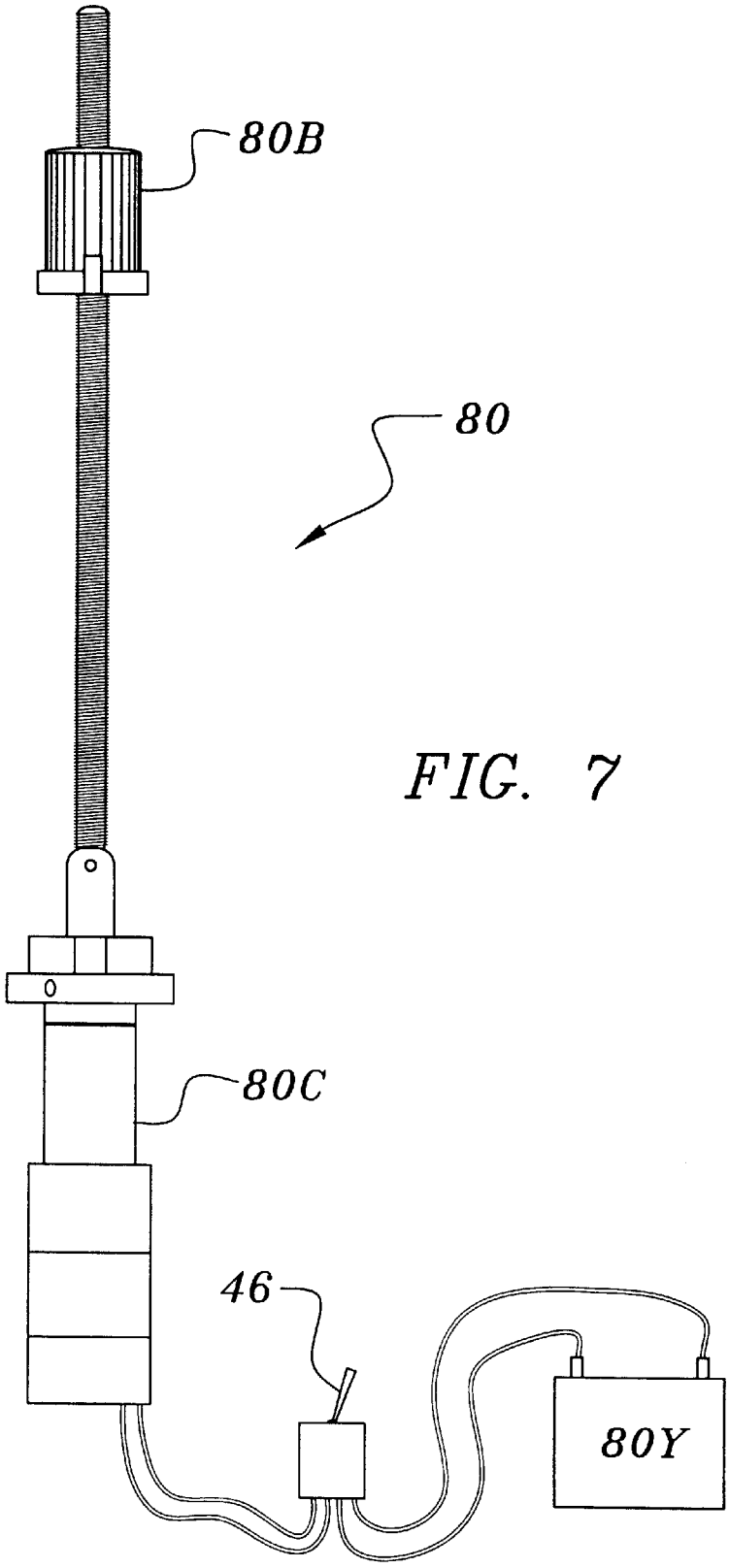
FIG. 7 is a side view of the preferred embodiment of a conventional linear actuator.

In both embodiments, a gas spring 40 (as shown in FIGS. 1–5) or a linear actuator 80 (as shown in FIG. 6) is connected between the inclinable frame 18IF and the fixed frame 18FF by respective pivot pins 181P and 18FP connected to the cylinder shackle 40CS and the rod end shackle 4ORS. In this regard it is noted that the spaced-apart, parallel positioning of the fixed and inclinable frame members allows room for the gas spring 40 or linear actuator 80 to lay between them when the headrest 20H is completely horizontal (i.e., not inclined). It is noted that in lieu of the inclinable frame 18IF and/or in lieu of the fixed frame 18FF, the gas spring 40 or linear actuator 80 may simply be pivotally connected to the underside of the inclinable portion of the bed 20 and to the carriaged framework 12 by means of brackets. It is further noted that, as shown in FIG. 5, the gas spring 40 or linear actuator 80 may be pivotally connected in reverse to that illustrated in FIGS. 1–4, and with the rod end shackle 4ORS being positioned closer to the lower bed 20LB and with the cylinder shackle 40CS end extending forwardly to be pivotally connected to the underside of the inclinable portion of the bed 20.

The preferred embodiment of the gas spring 40, as shown in FIG. 4, comprises a gas cylinder 40C including two chambers filled with compressed gas, with flow between the chambers being controlled by means of a valve. An extensible rod 40R is connected to a piston positioned in one of the chambers. A lever 46 is connected to the end of the extensible rod 40R and is operatively connected to the valve by means of an actuator pin 46P. The valve is normally biased to a non-actuated (closed) position. Actuation (i.e., movement) of the lever 46 causes the actuator pin 46P to be moved inwardly within the rod 40R and actuation (i.e., an opening) of the valve. Preferably, the degree of opening of the valve, and hence the speed of extension of the rod 40R, is controlled by the degree of actuation of the lever 46 that actuates the actuator pin 46P.

Upon actuation of the lever 46, the actuator pin 46P moved inwardly to cause actuation of the valve whereupon gas from one chamber is allowed to flow into the other chamber containing the piston thereby causing the extensible rod 40R to be forced outwardly to an extended position. Upon release of the lever 46, the actuator pin 46P returns to its original position to close the valve. While the valve is closed, the piston and thus the extensible rod 40R are held into position to prevent from any further extension or retraction of the rod 40R.

The extensible rod 40R may be retracted by actuating the lever 46 causing the actuator pin 46P to move inwardly of the rod 40R and actuate the valve to an opened position thereby allowing the forceful retraction of the extensible rod 40R whereupon the gas in the chamber containing the piston is forced back into the other chamber. Upon release of the lever 46, the actuator pin 46P moves outwardly to cause the valve to close. The rod 40R is thus held in its retracted position.

A more complete description of a typical gas spring 40 is found in U.S. Pat. No. 4,993,522, and the patents cited therein, the disclosures of which are hereby incorporated by reference herein. Preferably, the gas spring 40 employed is the TM "Bloc-O-Lift" gas spring (Model 731994) manufactured by Stabilus of Gastonia, N.C.

The preferred embodiment of the linear actuator 80 comprises an electrical device having a motor and gear arrangement contained within a cylinder 80C wherein when direct-current electrical energy is provided to the motor in one polarity, forcible rotation of the threaded rod 80R in one direction occurs and when the electrical energy is provide to the motor in the opposite polarity, forcible rotation of the threaded rod 80R occurs in the opposite direction, there causing the threaded boss 18B connected to pivot pin 18FP to travel along the length thereof. The electrical energy may be supplied by a rechargeable battery 80Y or the like. The lever 46 may simply comprise the lever of a double-pole, double throw momentary switch that is wired to the battery 80Y and the motor such that upon actuation of the lever 46 in one direction, the electrical energy flows to the motor in one polarity and upon actuation in the reverse direction, electrical energy flows to the motor is the reverse polarity. Preferably, the linear actuator 80 employed is the TM "VERSALIFT" linear actuator system manufactured by Suspa, Inc. USA of Grand Rapids, Mich.

Importantly, in all embodiments, the gas spring 40 or linear actuator 80 is interconnected between the inclinable frame 18IF and the fixed frame 18FF at an angle, such that the longitudinal axis of the gas spring 40 or linear actuator 80 is not ever parallel to the members of both the fixed and inclinable frames 18FF & 18IF even when both the fixed and inclinable frames 18FF & 18IF are parallel themselves as when the inclinable frame 18IF is not inclined. This may be accomplished by positioning the pivot pins 42 and 44 in the respective members of both the fixed and inclinable frames 18FF & 18IF to assure that they are not ever in the same horizontal plane.

The angular positioning of the gas spring 40 or linear actuator 80 allows the gas spring 40 or linear actuator 80 to operate properly to raise the headrest 20H or headrest/upper bed 20UB. Specifically, if the gas spring 40 or linear actuator 80 were to be positioned parallel with the members of both the fixed and inclinable frames 18FF & 18IF, the headrest 20H or headrest/upper bed 20UB would tend to bind and remain horizontal without rising. Therefore, as should be appreciated, it is the angular force exerted by the gas spring 40 or linear actuator 80 that is required to start the raising of the headrest 20H or headrest/upper bed 20UB.

In the case of the gas spring 40, the raising of the headrest 20H or headrest/upper bed 20UB may occur by simple operation of the lever 46 by the mechanic coupled with the mechanic lifting-up his head and upper torso to take the weight off the headrest or upper bed (i.e., by performing a slight sit-up), whereupon headrest 20H or headrest/upper bed 20UB rises automatically to the desired inclined level. The mechanic may then release the lever 46 to secure the headrest or upper bed in such an inclined position. In the case of the or linear actuator 80, the procedure is the same; however, there is less of a need to take the weight off of the headrest 20H or headrest/upper bed 20UB due to increased force created by the or linear actuator 80.

Conversely, in the case of the gas spring 40, the lowering of the headrest 20H or headrest/upper bed 20UB may occur by simple operation of the lever 46 by the mechanic, coupled with a backward pushing on the headrest 20H or headrest/upper bed 20UB by the mechanic's head or head & upper back, to force the headrest 20H or headrest/upper bed 20UB to lower to the desired level, whereupon the lever 46 may then released to secure the headrest 20H or headrest/upper bed 20UB in such a reduced inclined or flat position. In the case of the linear actuator 80, backward pushing is not required as the linear actuator 80 positively retracts upon reverse actuation of the lever 46.

The present disclosure includes that contained in the appended claims, as well as that of the foregoing description. Although this invention has been described in its preferred form with a certain degree of particularity, it is understood that the present disclosure of the preferred form has been made only by way of example and that numerous changes in the details of construction and the combination and arrangement of parts may be resorted to without departing from the spirit and scope of the invention.

Now that the invention has been described,

What is claimed is:

1. An inclinable creeper, comprising in combination:

a carriaged framework supporting a bed, said bed including an inclinable portion; and a mechanism for raising said inclinable portion upon actuation of a lever, for securing said inclinable portion to be forcibly lowered when said lever is actuated, said mechanism comprising a gas spring pivotally connected at an angle between said carriaged framework and said inclinable portion;

a fixed framework and an inclinable framework pivotally connected to said fixed framework with said gas spring being interconnected between said fixed framework and said inclinable framework, said fixed framework comprising at least one fixed member extending longitudinally along a portion of said carriaged framework, said inclinable framework comprising at least one inclinable member extending longitudinally along a portion of said inclinable portion substantially parallel to said fixed member, and said gas spring being interconnected between said fixed member and said inclinable member.

2. The inclinable creeper as set forth in claim 1, further comprising a pair of said inclinable members that are spaced apart from one another by a distance sufficient to allow said gas spring to be positioned therebetween and further comprising a pair of said fixed members that are spaced apart from one another by a distance sufficient to allow said pair of inclinable members to be positioned therebetween.

3. The inclinable creeper as set forth in claim 2, wherein said pair of said inclinable members of said inclinable frame are pivotally connected to said pair of said fixed members of said fixed frame by means of a pivot pin.

4. The inclinable creeper as set forth in claim 3, wherein said gas spring comprises a cylinder portion and an extensible rod, one of which is pivotally connected to said fixed frame and the other of which is pivotally connected to said inclinable frame such that upon extension of said rod from said cylinder portion, said inclinable frame is inclined.

5. The inclinable creeper as set forth in claim 4, wherein said lever is connected to said extensible rod and, upon actuation of said lever, an actuator pin within said extensible rod of said gas spring is caused to move inwardly to actuate said gas spring.

6. An inclinable creeper, comprising in combination:

a carriaged framework supporting a bed, said bed including an inclinable portion;

a mechanism for raising said inclinable portion upon actuation of a lever, for securing said inclinable portion when said lever is not actuated, and for lowering said inclinable portion when said lever is reverse actuated, said mechanism comprising a linear actuator pivotally connected at an angle between said carriaged framework and said inclinable portion; a fixed framework and an inclinable framework pivotally connected to said fixed framework with said linear actuator being interconnected between said fixed framework and said inclinable framework, said fixed framework comprising at least one fixed member extending longitudinally along a portion of said carriaged framework, said inclinable framework comprising at least one inclinable member extending longitudinally along a portion of said inclinable portion substantially parallel to said fixed member, and said linear actuator being interconnected between said fixed member and said inclinable member.

7. The inclinable creeper as set forth in claim 6, further comprising a pair of said inclinable members that are spaced apart from one another by a distance sufficient to allow said linear actuator to be positioned therebetween and further comprising a pair of said fixed members that are spaced apart from one another by a distance sufficient to allow said pair of inclinable members to be positioned therebetween.

8. The inclinable creeper as set forth in claim 7, wherein said pair of said inclinable members of said inclinable frame are pivotally connected to said pair of said fixed members of said fixed frame by means of a pivot pin.

9. The inclinable creeper as set forth in claim 8, wherein said linear actuator comprises a cylinder portion and an extensible rod, one of which is pivotally connected to said fixed frame and the other of which is pivotally connected to said inclinable frame such that upon extension of said rod from said cylinder portion, said inclinable frame is inclined.

10. The inclinable creeper as set forth in claim 9, wherein said lever is connected to said extensible rod and, upon actuation of said lever, electrical energy is supplied to the linear actuator one polarity and, upon reverse actuation of said lever electrical energy is supplied to the linear actuator in a reverse polarity.

* * * * *